US005201811A

United States Patent [19]

Lebold et al.

[11] Patent Number: 5,201,811

[45] Date of Patent: Apr. 13, 1993

[54] METHOD AND APPARATUS FOR THE MANUFACTURE OF UNITARY COMPLEX CORES

[75] Inventors: Donald R. Lebold, Fort Wayne; Christopher J. Lichtle, Decatur, both of Ind.

[73] Assignee: The Hamilton Foundry & Machine Co., Harrison, Ohio

[21] Appl. No.: 826,791

[22] Filed: Jan. 28, 1992

[51] Int. Cl.[5] ..... B22C 13/12

[52] U.S. Cl. ..... 164/28; 164/232; 164/228

[58] Field of Search ..... 164/28, 232, 228, 186

[56] References Cited

U.S. PATENT DOCUMENTS 2,386,326 10/1945 Lowther ..... 164/232

3,302,250 2/1967 Flitz ..... 164/232

FOREIGN PATENT DOCUMENTS 7904124 11/1980 Netherlands ..... 164/228

*Primary Examiner*—Richard K. Seidel

*Assistant Examiner*—Erik R. Puknys

*Attorney, Agent, or Firm*—Baker & Daniels

[57] ABSTRACT

A method and apparatus for the manufacturing in one operation of a complex core, such as a core for manufacturing a double-volute turbo-charger housing. The apparatus includes two separable core box halves and a segmented mandrel removably disposed between the two separable core box halves. The mandrel has two removable segments which allow for the removal of a completed core.

18 Claims, 2 Drawing Sheets

METHOD AND APPARATUS FOR THE MANUFACTURE OF UNITARY COMPLEX CORES

BACKGROUND OF THE INVENTION

The present invention relates to a method and apparatus for making unitary complex cores.

Cast metal parts are made by pouring molten metal into a two-piece mold consisting of a top portion, conventionally referred to as a cope, and a bottom portion conventionally referred to as a drag. Hollow metal parts are cast by forming a hollow cavity in the cast part by means of a core. The core is placed in the mold so that, as the molten metal is poured into the mold, the metal is displaced by the core and a cavity is thereby formed by the core within the cast metal part. Thus the core and the mold cooperate to define the cast metal part.

Prior art methods of producing a complex intricate core has consisted of manufacturing the core in sections, assembling the core sections and securing the sections together by means of glue. This prior art method is time consuming and expensive because the core sections had to be made individually and then assembled in a separate operation. The prior art method is also inaccurate as no two assemblies are put together in the same way.

In manufacturing double volute turbo charger housings, complex cores are required to form the intricate internal double volute cavity of the turbo charger housing. The core must be in the shape of a double volute in order to define the housing cavity when the turbo charger housing is cast. Prior art methods for manufacturing such complex cores have comprised forming two individual volutes and then assembling them into a core by means of gluing them together. As indicated above such prior art methods are unsatisfactory for the reasons given. Additional problems introduced by forming cores in sections is that this method may introduce dimensional inaccuracies in the cores. If the core dimensions vary from core to core, the metal parts cast with such cores will also have varying dimensions. In products such as double volute turbo charger housings, the dimensional tolerances of the internal double volute are exacting and should not vary since such variations would affect the performance characteristics of the turbo charger. Thus, it is desired to provide cores with close dimensional tolerances.

An additional problem which has been encountered in such double volute turbo charger housings which ma be caused by variation in core dimensions has been thermal cracking on the inside of the castings. When such cracks appear, turbo charger housings must be replaced. Turbo chargers are conventionally rebuilt after a certain number of hours or miles have been accumulated. If it is found, during such rebuilding, that the turbo charger housing is cracked, it cannot be reused and must be replaced. Thus, it is desirable to provide a core which eliminates thermal cracking of double volute turbo charger housings.

SUMMARY OF THE INVENTION

The present invention eliminates the problems of the prior art by providing a method and apparatus for making a unitary complex core.

The apparatus for making a unitary core according to the present invention includes a central mandrel which is sandwiched between the two halves of a core box which define the shape of the core. The mandrel is segmented and includes removable segments which allow the core to be removed from the mandrel, upon separation of the core box halves. The mandrel defines the connecting portion between the two halves of the core, thereby allowing both sides of the core to be simultaneously manufactured and the unitary core to be manufactured in a single core forming process.

The method of manufacturing a unitary complex core according to the present invention comprises providing two core box halves, providing a segmented mandrel, joining the box halves with the mandrel located intermediate the same, investing the core material into the core box, separating the core box halves, and removing the unitary core from the mandrel by removing segments of the mandrel.

One advantage of the present invention is that it eliminates the assembly time and labor required which conventionally fabricated complex cores.

Another advantage of the present invention is that it permits closer control of the dimensions of a complex core due to forming the complex core in one piece.

A further advantage of the present invention is that, due to closer control of the core dimensions and tolerances, cast products manufactured with cores made in accordance with the instant invention will exhibit improved performance characteristics and reducing or even eliminating thermal cracking.

BRIEF DESCRIPTION OF THE DRAWINGS

The above mentioned and other features and advantages of this invention, and the manner of attaining them, will become more apparent and the invention itself will be better understood by reference to the following description of an embodiment of the invention taken in conjunction with the accompanying drawings, wherein.

Figure 1:
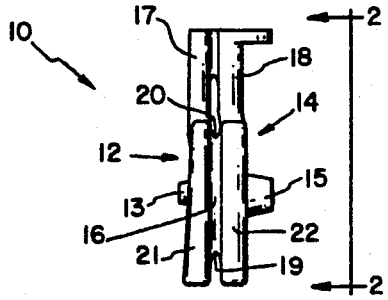
FIG. 1 is a side elevational view of a complex unitary core, namely a core for a turbo-charger housing.

Corresponding reference characters indicate corresponding parts throughout the several views of the drawings. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown a unitary complex core 10, illustrated here as a complex core for casting a double volute turbo-charger housing. While in this description the core is described in terms of a core for casting a double volute turbo charger housing, it should be understood that the method and apparatus according to the present invention can be used to manufacture various complex cores.

Core 10 includes two sections 12 and 14, each respectively having an axially outwardly projecting half-conical portion 13 and 15. Sections 12 and 14 are integrally connected by intermediate generally circular portion 16. Sections 12 and 14 each respectively include columns 17 and 18 which radially project from respective generally circular parts 21 and 22. Portion 16 defines a lower surface 19 and an upper surface 20 located between generally circular parts 21 and 22. I the prior art, sections 12 and 14 would be formed as two separate parts and would then be assembled (glued) at circular portion 16. However, a complex core such as double-volute core 10, may thus be manufactured as on piece with the apparatus and method of the present invention, thereby assuring the formation of cores with accurate and uniform dimensions. This in turn assures the accurate and uniform dimensions of the cast metal part made with such unitary complex core.

Figure 2:
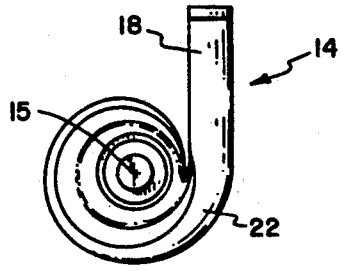
FIG. 2 is a view taken along line 2—2 of FIG. 1.
Figure 7:
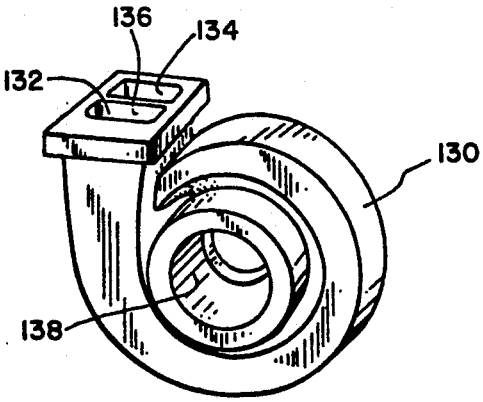
FIG. 7 is a perspective view of a double volute turbo charger which is manufactured with a core made according to the process and with the apparatus of the present invention.

Referring now to FIG. 7, there is shown a turbo charger housing which is cast with the aid of the core shown in FIGS. 1 and 2. Turbo charger housing 130 is a double volute turbo charger housing including two channels 132, 134 which are separated by a wall 136. Turbo charger housing also includes a central aperture 138.

Figure 3:
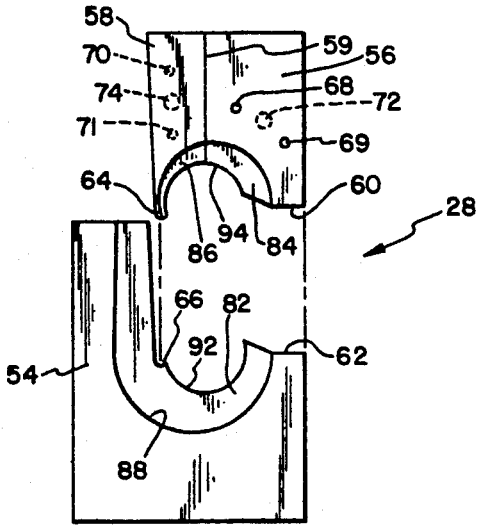
FIG. 3 is an exploded front elevational view of the mandrel according to an embodiment of the present invention.
Figure 5:
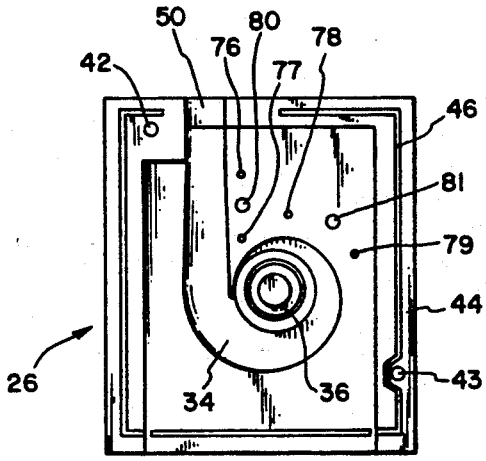
FIG. 5 is a front elevational view of one half of the core box according to the present invention.
Figure 4:
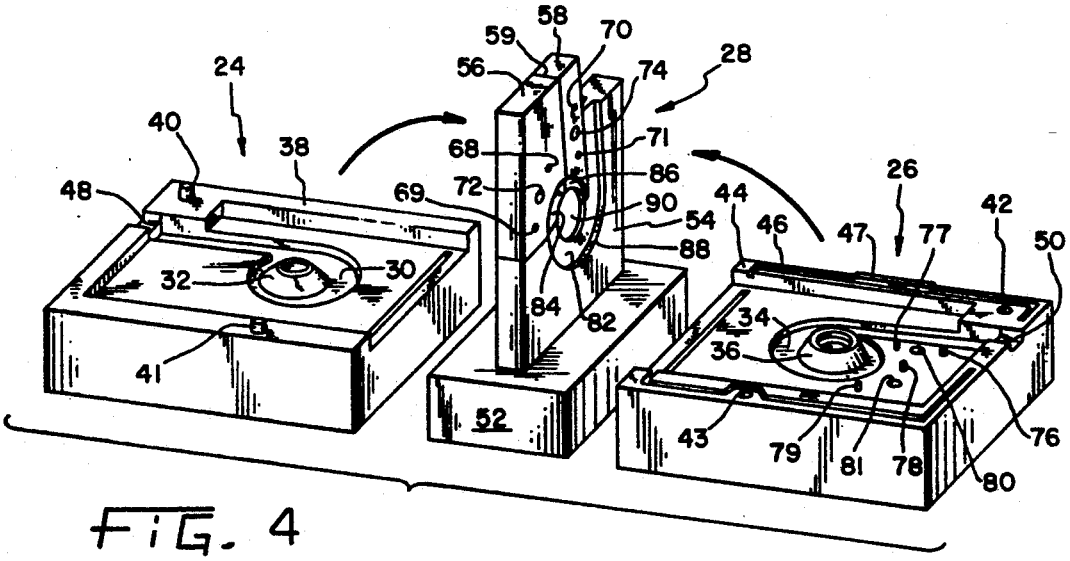
FIG. 4 is a perspective view of the core box and mandrel.

Referring now to FIGS. 3–5, a preferred embodiment of an apparatus according to present invention utilized in manufacturing the double volute turbo-charger (complex) core shown in FIGS. 1 and 2 will now be described. As shown in FIG. 4, the present invention consists of two core box halves 24 and 26 with a mandrel 28 located therebetween. Halves 24 and 26 are designed to close against and abut mandrel 28 as shown by the arrows. Core box half 24 includes a cutout 30 which defines the overall surface and shape of section 12 including a half-conical section 32 which defines half-conical portion 13. Core box half 26 includes a cutout 34 which defines the overall surface and shape of section 14 including a half-conical section 36 which defines half-conical portion 15.

Core box halves 24 and 26, as stated hereinabove, are designed to be joined together with mandrel 28 located therebetween. To this end, core box 24 includes a peripheral ridge 38 with two outwardly projecting pins 40 and 41 located thereon. Pins 40 and 41 are respectively matingly received in two bores 42 and 43 located in a peripheral ridge 44 of core box 26. Peripheral ridge 44 also includes a groove 46 which extends along the entire periphery of core box 26 and in which is located a rubber strip 47. Thus, as core box halves 24 and 26 are joined, the pin and hole combination prevents the boxes from sliding relative to each other, while strip 47 provides a seal. In addition, both core boxes 24 and 26 respectively include openings 48 and 50 which respectively communicate with cutouts 30 and 34 for injecting the core mixture material during investment of the core.

Mandrel 28 is mounted on a base 52. Mandrel 28 is segmented, consisting of three segments 54, 56, and 58. Segments 56 and 58 are removable from segment 54. Segments 56 and 58 are joined together at surface 59. The removability of segments 56 and 58, as described hereinbelow in connection with the process of forming the core, allows the removal of core 10 once it has hardened. Segment 56 has a bottom surface 60 which rests on an upper surface 62 of segment 54, while segment 58 has a lip 64 that rests in a recess 66 of segment 54. Since segments 56 and 58 only rest on segment 54, i.e. are not locked to, there are respectively provided on segments 56 and 58 two holes 68, 69 and 70, 71 as well as magnets 72 and 74. Pins 76, 77, and 78, 79 are respectively received in holes 68, 69 and 70, 71 while magnets 72 and 74 are contacted respectively by opposite polarity magnets 80 and 81 all of which are, in turn, disposed on core box half 26. Thus, segments 56 and 58 are held onto core box half 26 and rest on mandrel segment 54 when the core box is assembled.

Each segment 54, 56, and 58 of mandrel 28 also has a respective recessed area 82, 84, and 86 located on either side of mandrel 28 (of which only one side is shown). These recessed areas collectively define the inner shape of circular portions 21 and 22 of sections 12 and 14 of core 10. Recessed area 82 in section 54 also defines a ledge 88. As the core box is invested, i.e. core material is injected into the core box, these recessed areas 82, 84, and 86 as well as ledge 88 provide support and definition for circular portions 21 and 22 while void 90 in mandrel 28 produces intermediate generally circular portion 16 of core 10. As stated hereinabove, portion 16 is the connecting portion joining sections 12 and 14. Surfaces 92 and 94 of segments 54, 56, and 58 define the upper and lower boundaries 19 and 20 of portion 16.

Figure 6:
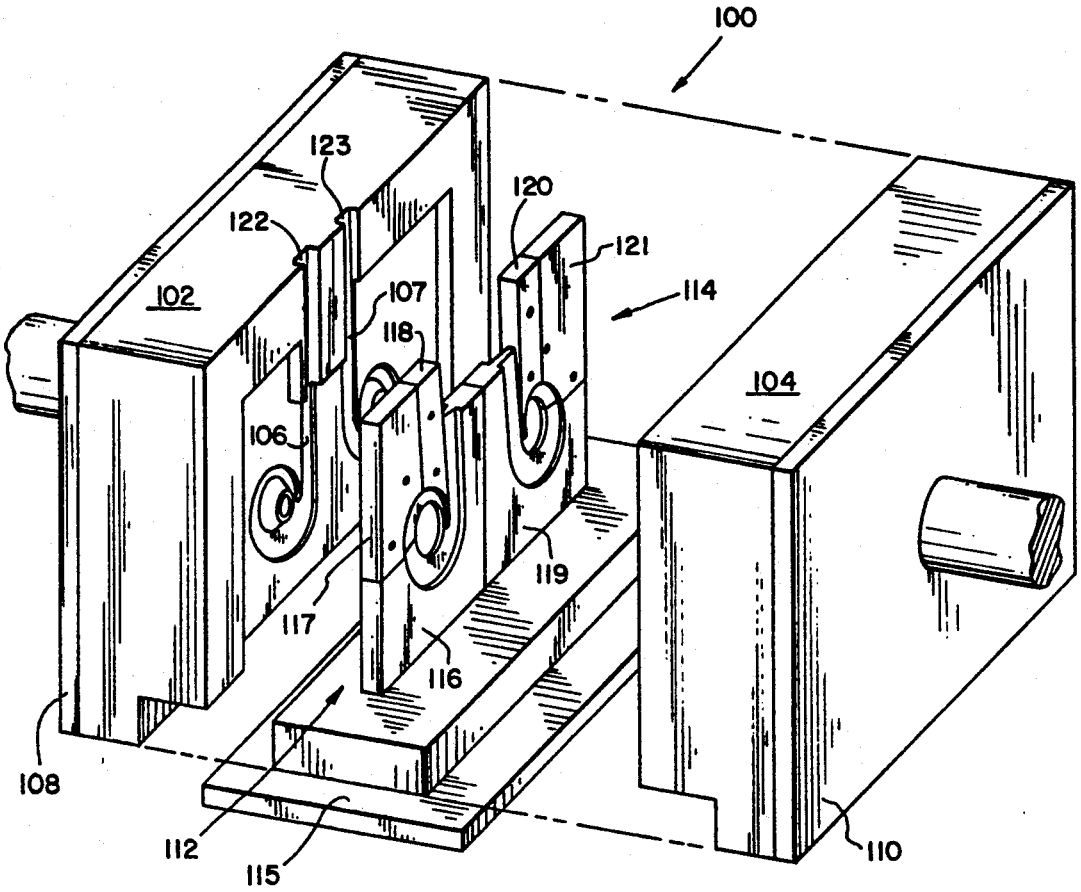
FIG. 6 is a perspective view of a double core box with double mandrels according to the present invention.

Referring now to FIG. 6, there is shown a core box 100 that can simultaneously form two cores. It should be noted that a core box may be constructed for simultaneously forming any desired number of cores, dependent only upon the type of machine utilized to form the cores. Generally, core box 100 includes two box halves 102 and 104 each having their respective cutouts 106, 107 (the interior of only one core box half is shown). Box halves 102 and 104 are respectively mounted on platens 108 and 110 Two mandrels 112 and 114 are shown mounted on a common base 115. Mandrels 112 and 114 each respectively consist of three segments 116, 117, 118, and 119, 120, 121. Each cutout 106 and 107 is in communication with investment apertures 122 and 123 whereinto the core material is injected. It should be noted that the cutouts 106 and 107 are preferably so oriented that the investment apertures are as close as possible to each other. The principles of construction and operation shown and described with reference to the single core box of FIGS. 3—5 also apply to the core box of FIG. 6 and to all multiple core boxes constructed according to the present invention.

With reference to all the figures and particularly FIG. 4, the operation or process of manufacturing a unitary complex core according to the present invention will now be described. Initially, core box halves 24 and 26 are separated from each other, each core box half being mounted on a separate platen (not shown) of a core making machine. Mandrel segments 56 and 58 are assembled in core box half 26. The respective pins, holes and magnets are matingly interconnected so as to hold segments 56 and 58 rigidly dimensionally with respect to core box half 26. Mandrel segment 54 mounted on base 52 is then shuttled into the core making machine so as to be located intermediate core box halves 24 and 26. Core box halves 24 and 26 are then moved towards mandrel 28 until they are located adjacent mandrel 28. Pins 40 and 41 are thus respectively received in holes 42 and 43 while strip 47 is compressed in groove 46 to provide a proper seal. Thus the mandrel is now complete, having sections 54, 56, and 58 interconnected.

The core mixture is invested into the core box through apertures 48 and 50 after which a gas is injected into apertures 48 and 50 to solidify the core. Core box halves 24 and 26 are then withdrawn from mandrel 28 and the mandrel is shuttled out of the machine.

Applicants have successfully used a core making machine manufactured by Laempe GmbH of Schopfein Germany. In this machine platens located in the machine carry the core box halves 24 and 26. The core box halves 24 and 26 are mounted o the platens and the mandrel, carried on base 52, is shuttled into and out of the machine. Thus the mandrel, mounted on base 52, is initially located outside of the machine. Mandrel segments 56 and 58 are assembled on core box half 26, mandrel segment 54 on base 52 is then shuttled into the machine and the platens carrying core box halves 24 and 26 are moved towards each other and against base 52 by means of pneumatic pressure. Similarly, after investment of core material into the core box and after curing of the core with a gas, the platens and core box halves 24 and 26 are moved away from mandrel 28 and base 52 by the pneumatically operated mechanism. The mandrel 28, carrying the solidified core, is then shuttled out of the machine.

In the above described Laempe machine, the process used for solidifying and curing the core is known as an "isocure" process. However, it should be understood that Applicants' invention is not limited to the use with a Laempe machine nor to the use of the "isocure" core hardening process. Various other conventional core curing processes could be used such as cold box processes, e.g. the "novaset" process, the "shell" process and the "oil sand" process. Thus, Applicants' invention could be used with any suitable core curing process. Furthermore, Applicants invention may be used with various types of core making machines, some of which may use an entirely automated process, whereas others of which may use manual operating steps.

Continuing now with the core forming process, in order to strip core 10 from mandrel 28, mandrel segment 56 is first removed by pulling it away from core 10. Thereafter, mandrel segment 58 is removed by rotation of segment 58 through approximately 30 degrees and then pulling segment 58 away from core 10. At this time core 10 rests only on mandrel segment 54. Core 10 is then rotated approximately 20 degrees about segment 54 and is pulled therefrom. Thus it can be seen that the advantageous construction of the mandrel 26 by means of segments 54, 56 and 58 permits the removal of the completed core from the mandrel by removing the segments of the mandrel one at a time. Additionally, due to the particular structure of the illustrated core for the double volute turbo charger, rotation of the segments of mandrel 28 relative to the core is necessary to remove the core from mandrel 28.

The operation of a multiple core box as shown in FIG. 6 is similar to the operation of a single core box as shown in FIGS. 3–5, the only difference being that several mandrels need to be assembled prior to the investment of the core box and several mandrels need to be disassembled to remove the various cores from the mandrels.

Thus, Applicants have provided an advantageous apparatus and method for manufacturing unitary complex core by the provision of a core box with a segmented mandrel.

It should be understood that, while Applicants have illustrated the invention by means of a double volute core for a turbo charger housing, the invention described herein is applicable to other types of complex cores. The provision of a segmented mandrel makes possible the making of such cores as unitary structures.

While this invention has been described as having a preferred design, the present invention can be further modified within the spirit and scope of this disclosure. For instance, other methods for removing the segments of a mandrel could be contemplated, depending on the shape of the core. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for manufacturing a core, the apparatus comprising:

a core box including separable first and second sections, said first and second sections having respective first and second interior faces, said first and second interior faces having respective first and second cavities therein which define respective first and second portions of a said core to be formed in said apparatus;

an investment aperture means in said box for receiving core material, said aperture means being in communication with said first and second cavities; and a segmented mandrel disposed intermediate said first and second sections defining separate first and second chambers respectively with said first and second cavities, said segmented mandrel having an opening therethrough allowing communication between said first and second chambers for forming an interconnecting portion between said first and second portions of a said core.

2. The apparatus of claim 1, wherein said mandrel comprises first and second segments, said second segment being removable from said first segment to permit removal of a said core from said mandrel.

3. The apparatus of claim 2, wherein one of said segments is rotatable relative to a said core formed in said apparatus.

4. The apparatus of claim 2, including means for removably securing said segments to said sections.

5. The apparatus of claim 4, wherein said securing means comprises:

a first magnet disposed on said mandrel; and a second magnet of opposite polarity to said first magnet, said second magnet disposed on the interior face of one of said sections.

6. The apparatus of claim 4, wherein said securing means comprises:

an aperture disposed in one of said segments; and a pin disposed on the interior face of one of said sections, said pin removably receivable in said aperture.

7. The apparatus of claim 4 wherein said securing means comprises:

a first magnet disposed in one of said segments;

a second magnet of opposite polarity to said first magnet, said second magnet disposed on the interior face of one of said sections;

an aperture disposed in one of said segments; and a pin disposed on the interior face of one of said sections, said pin removably receivable in said aperture.

8. An apparatus for manufacturing a core, the apparatus comprising:

a box including separable first and second sections, said first and second sections each having an interior face, said interior faces respectively having first and second cavities therein for defining respective portions of a core;

an investment aperture means in said box for receiving core material, said aperture means being in communication with said first and second cavities; and a mandrel disposed intermediate said first and second sections and defining first and second chambers respectively with said first and second cavities, said mandrel including a plurality of segments, at least one of said segments being removable to permit a said core to be removed from said mandrel, said mandrel including an opening therethrough for forming an interconnecting portion between said respective core portions whereby a said core is formed as one piece.

9. The apparatus of claim 8, further comprising means for removably attaching said plurality of segments to the interior face of one of said sections.

10. The apparatus of claim 9 wherein said attaching means comprises:

a first magnet disposed in a first of said segments;

a second magnet of opposite polarity to said first magnet, said second magnet disposed on the interior face of one said sections;

a plurality of apertures disposed in said plurality of segments; and a plurality of pins disposed on the interior face of one said sections, said pins removably receivable in said plurality of apertures.

11. A method of manufacturing a core, the method comprising the steps of:

providing a first core box section and a second core box section, said first and second box sections each having an interior face, said first and second sections respectively having first and second cavities therein and defining respective portions of a said core, and an investment aperture means for curing core material in communication with said first and second cavities;

providing a segmented mandrel and inserting said mandrel between said first and second sections such that said segmented mandrel defines first and second chambers with said first and second sections;

securing said first and second sections to said mandrel to form a core box;

investing core material into said investment aperture means;

curing said core material;

separating said first and second box sections;

removing a segment from said mandrel; and removing a said core from said mandrel.

12. The method according to claim 11, wherein said removing step includes rotating said segment relative to a said core.

13. The method of claim 11 wherein said securing step includes removably attaching said segmented mandrel to a said core box section.

14. The method of claim 11 wherein the step of removing a said core includes rotating said core relative to said mandrel.

15. A method of manufacturing a core, the method comprising the steps of:

providing a first core box section and a second core box section, said first and second core box sections each having an interior face, said interior faces respectively having first and second cavities therein for defining respective portions of a said core, and an investment aperture means for receiving core material in communication with said first and second cavities;

assembling a mandrel from a plurality of mandrel segments, such that said mandrel has an opening therethrough;

inserting said segmented mandrel between said first and second sections such that said mandrel defines first and second chambers respectively with said first and second cavities, said first and second chambers being in communication via said opening whereby said core is formed as one piece;

securing said first and second box sections and said mandrel to each other;

investing core material into said investment aperture means;

curing said core;

separating said first and second box sections; and removing a segment from said mandrel.

16. The method of claim 15 wherein said securing step includes removably attaching one said mandrel segments to the interior face of one said box section.

17. The method of claim 15 wherein the step of removing said segment includes rotating said segment relative to a said core.

18. The method according to claim 15 wherein the step of removing said core includes rotating the core relative to said mandrel.

* * * * *